US009011198B2

(12) United States Patent
Shelton

(10) Patent No.: US 9,011,198 B2
(45) Date of Patent: Apr. 21, 2015

(54) BRA STRUCTURE

(76) Inventor: Christopher Shelton, London (GB)

( * ) Notice: Subject to any disclaimer, the term of this patent is extended or adjusted under 35 U.S.C. 154(b) by 134 days.

(21) Appl. No.: 13/474,216

(22) Filed: May 17, 2012

(65) Prior Publication Data

US 2012/0295515 A1 Nov. 22, 2012

(51) Int. Cl.

| | |
|---|---|
| ***A41C 3/12*** | (2006.01) |
| ***A41C 1/06*** | (2006.01) |
| *A41C 3/00* | (2006.01) |

(52) U.S. Cl.

CPC ..... *A41C 1/06* (2013.01); *A41C 3/0021* (2013.01)

(58) Field of Classification Search

CPC ..... A41C 3/00; A41C 3/0021; A41C 3/12; A41C 3/122

USPC ..... 450/48, 41, 59, 86, 50, 60, 62, 87

See application file for complete search history.

(56) References Cited

U.S. PATENT DOCUMENTS

| | | | | | |
|---|---|---|---|---|---|
| 2,463,319 | A | * | 3/1949 | Schwartz | 450/45 |
| 2,480,049 | A | * | 8/1949 | Rosenberg | 450/45 |
| 2,483,272 | A | * | 9/1949 | Gluckin | 450/48 |
| 2,484,440 | A | * | 10/1949 | Witkower | 450/59 |
| 2,553,225 | A | * | 5/1951 | Weaver et al. | 450/59 |
| 2,574,962 | A | * | 11/1951 | Curran | 450/48 |
| 2,586,529 | A | * | 2/1952 | Gluckin | 450/48 |
| 2,607,038 | A | * | 8/1952 | Spare | 450/59 |
| 2,636,174 | A | * | 4/1953 | Williams | 450/50 |
| 2,644,947 | A | * | 7/1953 | Schwartz | 450/48 |
| 2,660,729 | A | * | 12/1953 | Katz | 450/48 |
| 2,691,168 | A | * | 10/1954 | Roth | 450/3 |
| 2,731,640 | A | * | 1/1956 | Garson | 450/45 |
| 2,769,180 | A | * | 11/1956 | Tareau et al. | 450/45 |
| 2,776,433 | A | * | 1/1957 | Schaumer | 450/48 |
| 2,912,983 | A | * | 11/1959 | Horn | 450/45 |
| 2,923,300 | A | * | 2/1960 | Ots | 450/45 |
| 2,954,031 | A | * | 9/1960 | Froehlich | 450/48 |
| 3,033,208 | A | * | 5/1962 | Mathiesen | 40/372 |
| 3,304,940 | A | * | 2/1967 | Holscher | 450/59 |
| 5,527,202 | A | * | 6/1996 | Morgan et al. | 450/48 |
| 6,019,662 | A | * | 2/2000 | Fildan | 450/41 |
| 6,203,400 | B1 | * | 3/2001 | Allen et al. | 450/41 |
| 8,460,055 | B2 | * | 6/2013 | Cheng | 450/41 |
| 2011/0124268 | A1 | * | 5/2011 | Cheng | 450/52 |

FOREIGN PATENT DOCUMENTS

| | | |
|---|---|---|
| EP | 1274326 | 1/2003 |

* cited by examiner

*Primary Examiner* — Gloria Hale
(74) *Attorney, Agent, or Firm* — J. Wiley Horton

(57) ABSTRACT

A bra structure is provided which substantially balances the tensions in the straps to relieve discomfort for the wearer.

10 Claims, 10 Drawing Sheets

BRA STRUCTURE

CROSS-REFERENCES TO RELATED APPLICATIONS

This application claims priority—pursuant to 35 U.S.C. §119(a)-(d)—to an earlier-filed foreign application. The foreign application was earliest filed on 17 May, 2011 in the United Kingdom Patent Office and lists the same inventor. It was assigned UK Patent Application No. GB1108230.2. The UK Patent Application No. GB1108230.2, dated Mar. 5, 2012, claims the priority of the previously filed UK Patent Application No. GB1203802.2.

STATEMENT REGARDING, FEDERALLY SPONSORED RESEARCH OR DEVELOPMENT

Not Applicable.

MICROFICHE APPENDIX

Not Applicable

BACKGROUND OF THE INVENTION

1. Field of the Invention

The present invention relates to bras, in particular to a structure of bra which can provide maximum support together with minimum discomfort for the wearer.

2. Description of the Related Art

The main purpose of a bra is to support the breasts of the wearer by transferring the forces involved in the support to other parts of the body, principally the shoulders and the rib cage. In a conventional bra it is tension in the front part of each bra strap which carries most of the weight of each breast.

Conventional bras are often uncomfortable, particularly for those women whose breasts are large.

Support relies on the bra gripping the rib cage. For larger breasts the band tension can reach over 20N. This is uncomfortable in itself and results in most wearers settling for a looser tension. This however leads to the back band of the bra slipping, and failing to fulfil its function. The shoulders exert more force than they need and the subsequent unnecessary pressure causes discomfort. Conventional bra structures also generate a forward force on the shoulders which can lead to a side effect of poor posture for the wearer:

In order, to stabilize the position of the bra structure some means must be provided to ensure that the bra strap tension is equalized front and back. The weight of the breast is only at the front and this has to be balanced by equal forces produced in the remainder of the bra structure. EP1274326 discloses a bra structure which better equalises the strap tension front and back so as to minimise distortion of the bra structure and the consequent discomfort for the user. The structure disclosed in EP1274326 describes how a bra can be constructed without high tension in the back band and underhand and can also reduce shoulder strap tension by balancing shoulder strap lift against lift at the side of the cup by a novel rigid wing.

The present invention aims to improve on the structure disclosed in EP1274326.

BRIEF SUMMARY OF THE PRESENT INVENTION

According to the present invention there is provided a bra structure comprising a pair of cup members, pair of shoulder straps each having a front end and a back end, respective side members interconnecting the cup members and the back end of the shoulder strap, and a substantially triangular frontal region interconnecting the cup members and the front end of the shoulder strap at either side thereof, each cup member adapted to be tensioned by the shoulder strap of the opposing side when worn, each cup member comprising a sling, the sling being symmetrical about a vertical axis whereby when worn the cup member extends up and behind the breast of the wearer.

The invention also provides a bra structure comprising a pair of cup members, a pair of shoulder straps each having a front end and a back end, respective, side members interconnecting the cup members and the back end of the shoulder strap, and a frontal semi rigid bridge member extending forwardly and interconnecting the cup member and the front end of the shoulder strap at either side thereof, whereby when worn the front end of each shoulder strap is held away from the rib cage by the ridge member, the shoulder strap thus exerting a radially inward horizontal force towards the wearer.

The invention further provides a bra structure comprising a pair of clip members, a pair of shoulder straps each having a profit end and a back end, respective side members interconnecting the cup members and the back end of the shoulder strap, a frontal semi rigid bridge member extending forwardly and interconnecting the cup member and the front end of the shoulder strap at either side thereof, each cup member comprising a sling, the sling being symmetrical about a vertical axis whereby when worn the cup member extends up and behind the breast of the wearer.

Preferably the interconnecting side members are formed of a semi rigid material.

In a further embodiment additional side control may be provided by a springy elongate control member.

By distributing the lift the pressure on the shoulder of the wearer is reduced.

A further advantage of the invention is that very little pressure on the rib cage is experienced by the wearer.

BRIEF DESCRIPTION OF THE SEVERAL VIEWS OF THE DRAWINGS

In order that the invention may be more clearly understood reference will now be made to the accompanying drawings, given by way of example only, in which.

REFERENCE NUMERALS

| | | | |
|---|---|---|---|
| 1 | cup members | 2 | bridge member |
| 3 | shoulder strap | 4 | extended rigid wing |
| 5 | backband | 6 | underband |
| 7 | rigid wing | 8 | attachment point |
| 9 | attachment point | 10 | attachment point |
| 11 | attachment point | 12 | control member |
| 14 | attachment point | 15 | piece of fabric |
| 16 | attachment point | 17 | underband |
| 18 | side panel | 20 | means |
| 21 | ventilation space | 22 | prior art cups |
| 23 | point | 24 | prior art under band |
| 32 | breast of wearer | 34 | ribcage of wearer |

DETAILED DESCRIPTION OF THE INVENTION

Figure 1:
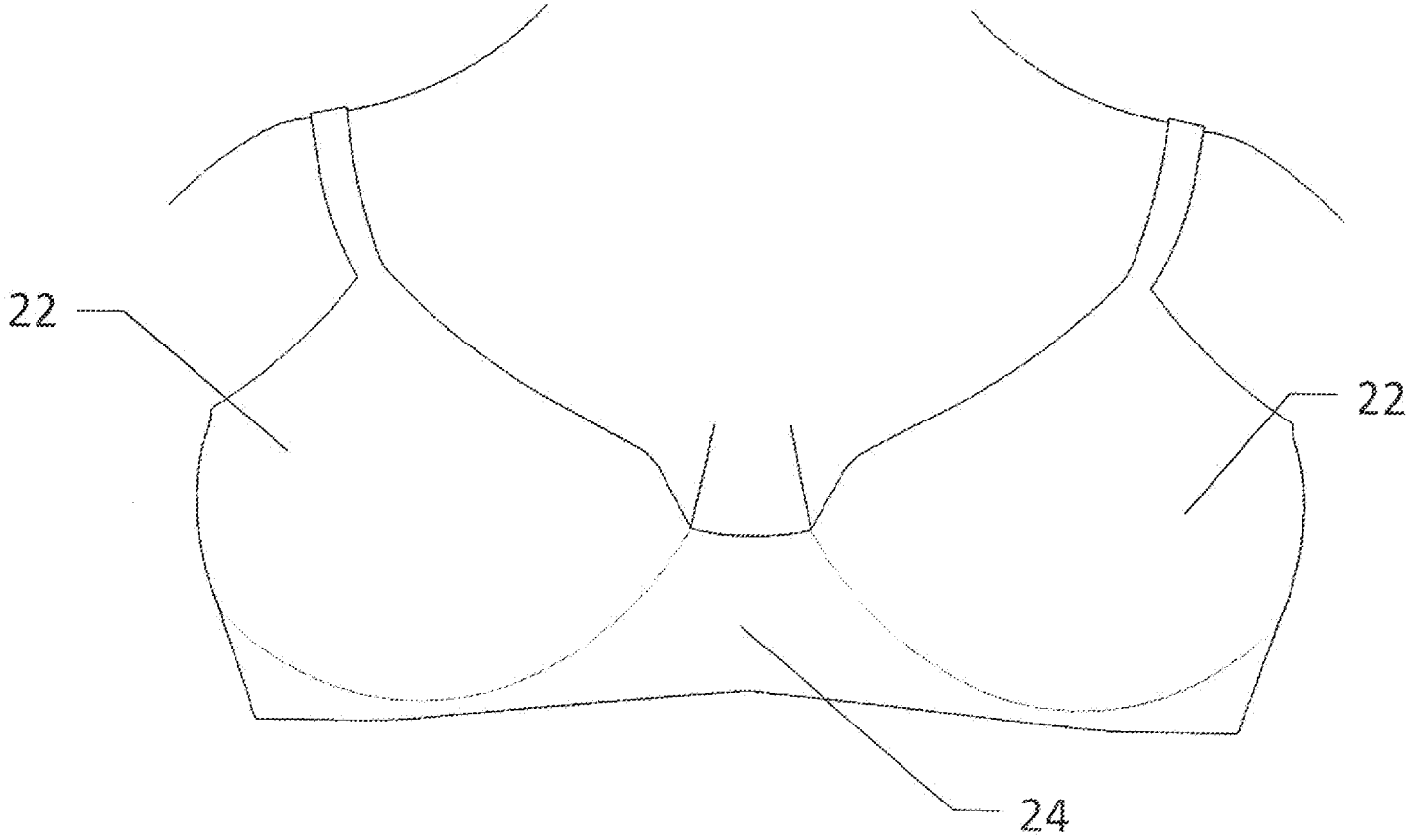
FIG. 1 is a diagrammatic front view of a conventional bra structure.

FIG. 1 illustrates a conventional bra structure showing the cups and underhand 17 found in bras known in the prior art.

The present invention discloses a bra structure in which there are less vertical tensions in the straps than a conventional bra. This leads to greater comfort for the wearer.

The range of naturally occurring bust sizes is extensive which means that bra cups have to be designed in a wide range of different sizes. As the volume of the bra cup increases the position of the lower edge of the cup changes from being worn where the bottom of the breast joins the chest to being worn below that point. This is so as to accommodate increasing volumes. In very large cups the vertical distance between the bottom of the cup and the point where the breast joins the chest wall can be several inches.

Figure 2:
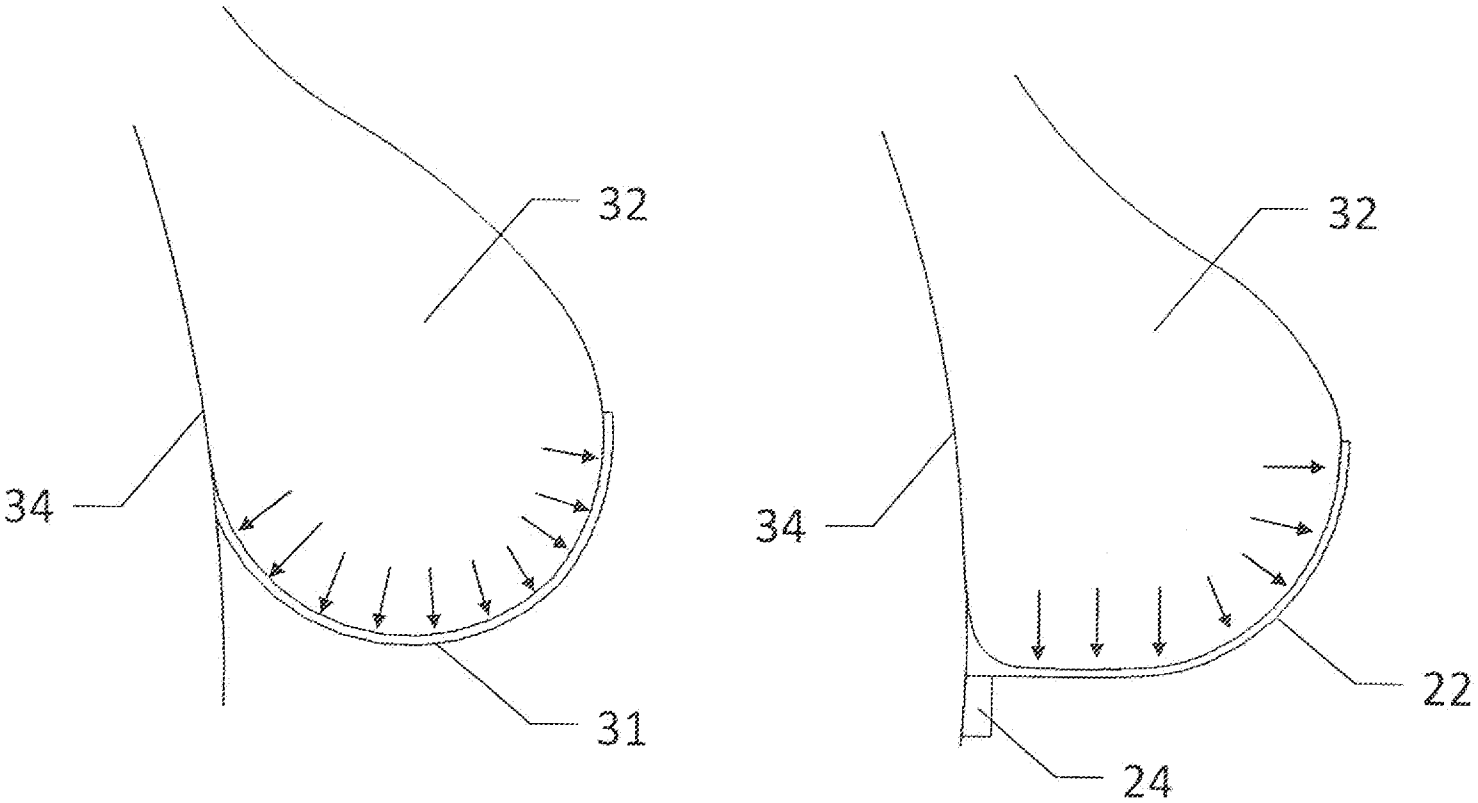
FIG. 2*a* illustrates the pressure distribution in a cup structure in accordance with the invention and in a conventional cup structure.

In providing lift and containment the cup exerts pressure on the breast and the breast exerts pressure equally on the cup. This pressure is provided by forces in the rest of the bra structure. A bra cup exerts pressure upwards at the lower part of the cup and also pressure inwards the further up the cup. The pressure is zero at the top edge of the cup and increases gradually to a maximum at the bottom. The pressure is essentially hydrostatic. However from time to time body movements can gently alter all forces. In a conventional bra cup with underwire the pressure of the breast inside the cup pushes all over the surface of the cup in such a direction that the net force on the cup has a component away from the chest. The weight exerts a force downwards on the cup but the asymmetry of the pressure exerts a force on the cup away from the chest. This force has to be provided by horizontal tension in the back band. The pressure distribution for the cup member in accordance with the present invention and for a conventional cup member are shown in FIGS. 2*a* and 2*b* respectively. The length of the arrows signify the magnitude of the vector. As can be seen the conventional cup member has a net force on it which tends to push it away from the rib cage. A conventional bra uses an underhand 17 and underwires to control the shape and support of the inter cup region. The cup member 1 of the present invention, shown in FIG. 2A extends behind the breast and thus has a symmetric pressure distribution. The backwards pressure balances the forward pressure. Very little, or no, force is therefore required to keep the cup members in place. Only vertical forces are required to be balanced.

Figure 3:
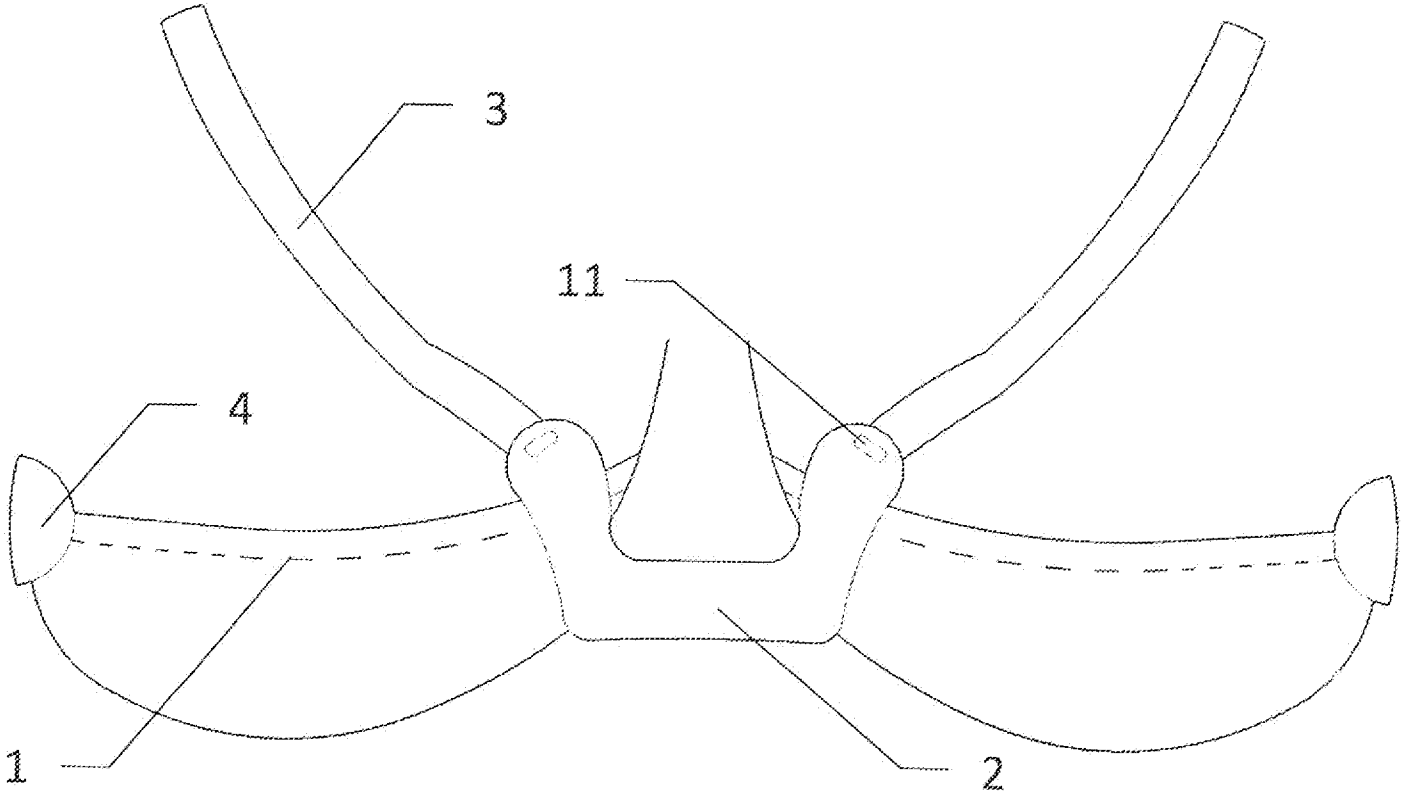
FIG. 3 is a diagrammatic front view of a bra structure in accordance with an embodiment of the invention.

FIG. 3 illustrates a bra structure in accordance with the invention in which there are substantially no lateral forces and the cup will be statically stable with no lateral horizontal tension constructions, though under conditions of body movement horizontal stability bands might be advisable.

Figure 4:
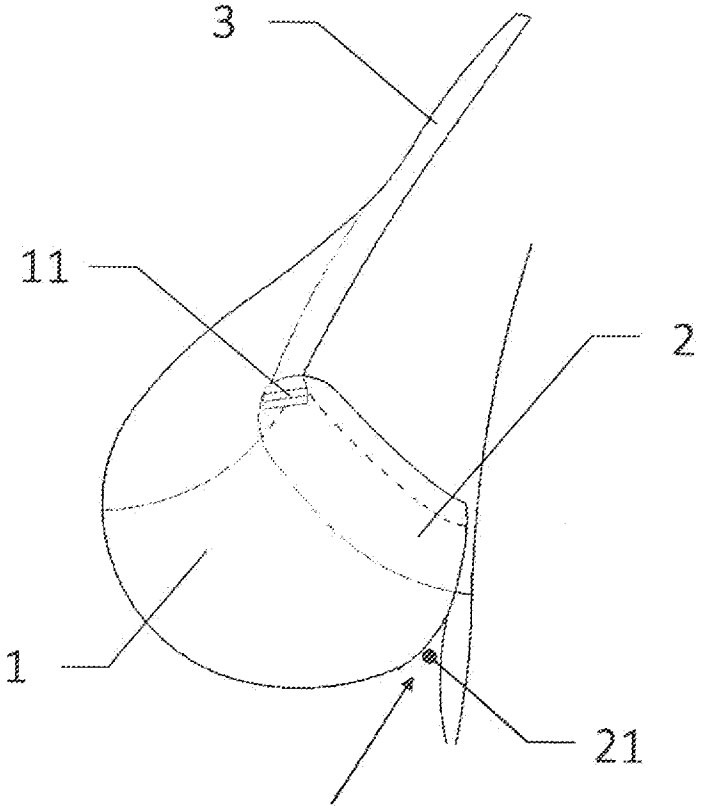
FIG. 4 is a diagrammatic side view of the bra structure in accordance with an embodiment of the invention.

Referring to FIG. 3 two cup members 1 (sling cups) are connected by a central rigid bridge member 2. It will be understood by those skilled in the art that rigid does not mean completely unyielding. The member has some flexibility. The rigid bridge member 2 is essentially U shaped. A narrow flat horizontal part of bridge member 2 is designed to sit on the sternum of the wearer. Two side components extend upwardly and outwardly from the horizontal part. Towards the upper end of each side component of the bridge member 2 there is provided an attachment point 11, best seen in FIG. 4. As can be seen in FIG. 4 the cups 1 are symmetrical in shape about the vertical axis and support the breast when worn.

As the sling cup preserves the breast's rounded shape underneath a space, or gap, is left. This is indicated by the arrow in FIG. 4. This is a ventilation space into which material or structured components can be inserted so as to maintain the space, even under pressure of clothing worn above the bra structure. The material could be, for example, open cell foam or compliant mouldings. However, these are examples only and it will be understood by those skilled in the art that any suitable material can be used. The ventilation space allows air to circulate in the space between the skin on the rib cage, and the skin on the back of the breast. This reduces the moisture level when the bra structure is worn thus reducing the instances of under bust infections.

The inner side of each cup is attached to the bridge member at attachment point 11. The outer side of each cup may be attached to a rigid wing 7 which forms the side of the bra structure. This is described in more detail later. A fabric in tension which will ultimately be attached to a shoulder strap 3 extends from each attachment point 11 of the bridge member. When the bra is worn these shoulder straps extend in an upward and outward direction to pass over the shoulders of the wearer and so provide vertical forces. The other end of each shoulder strap 3 is attached to the rigid wing 7 as described later. It will of course be understood that the bra structure is entirely symmetrical.

The sling cups 1 are symmetrical from front to back. The pressure of the breast on the cup occurs both backwards as well as forwards and of course downwards. To a large extent the backwards pressure balances the forward pressure so that if the cup were to be lifted in a symmetrical manner there would be no lateral net force and the cup would be stable with no radial horizontal tension constructions required. To support the cup in the practical asymmetric arrangement accommodating the curvature of the chest a forwardly extending rigid wing may be provided to form the side of the structure and the central rigid bridge member 2 extends forward of the cup so as to provide lift away from the chest wall. In this way the back pressure and the forward pressure can be balanced.

Figure 5A:
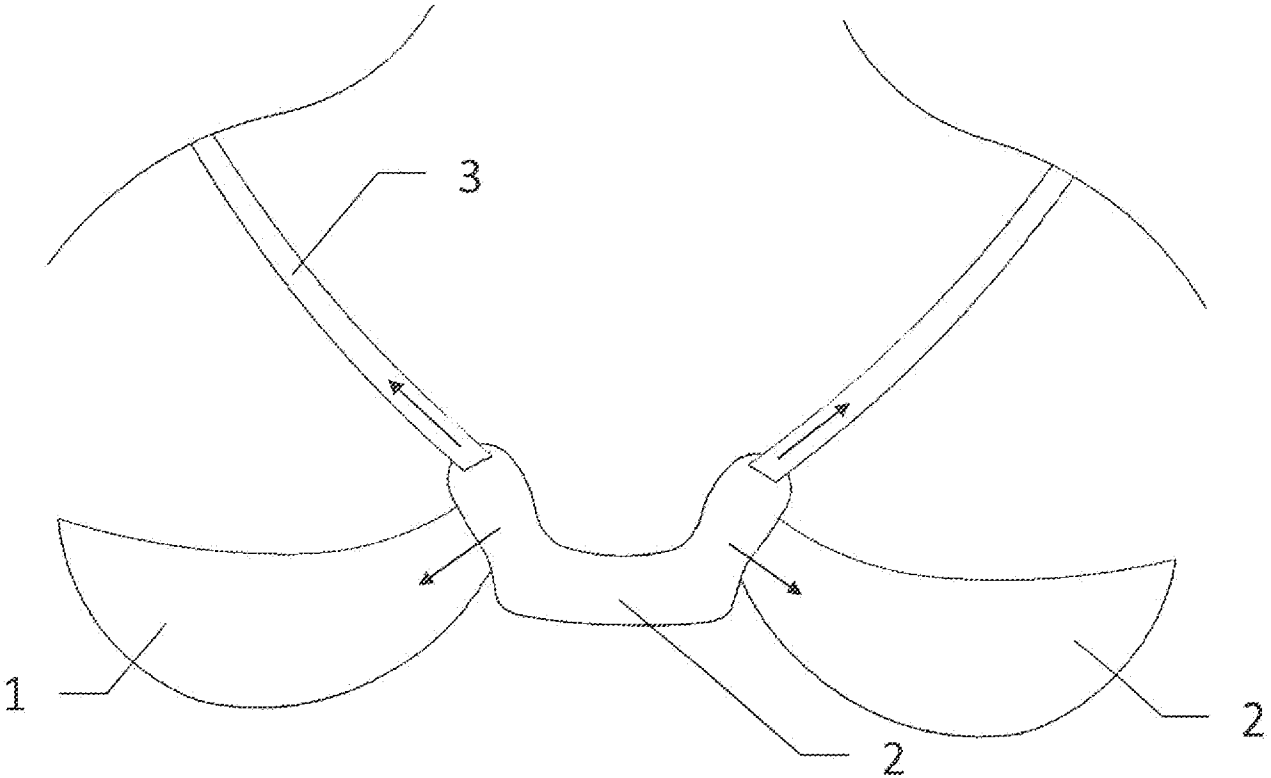
FIGS. 5A, 5B and 5C are a front elevation, side elevation and plan respectively of the bra structure in accordance with the invention illustrating the forces acting on the rigid bridge member.
Figure 5B:
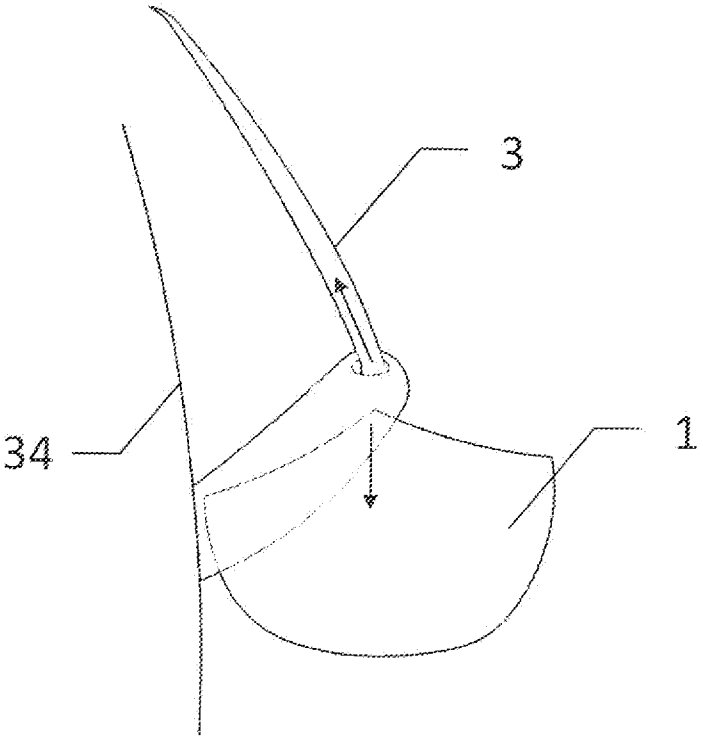
Figure 5C:
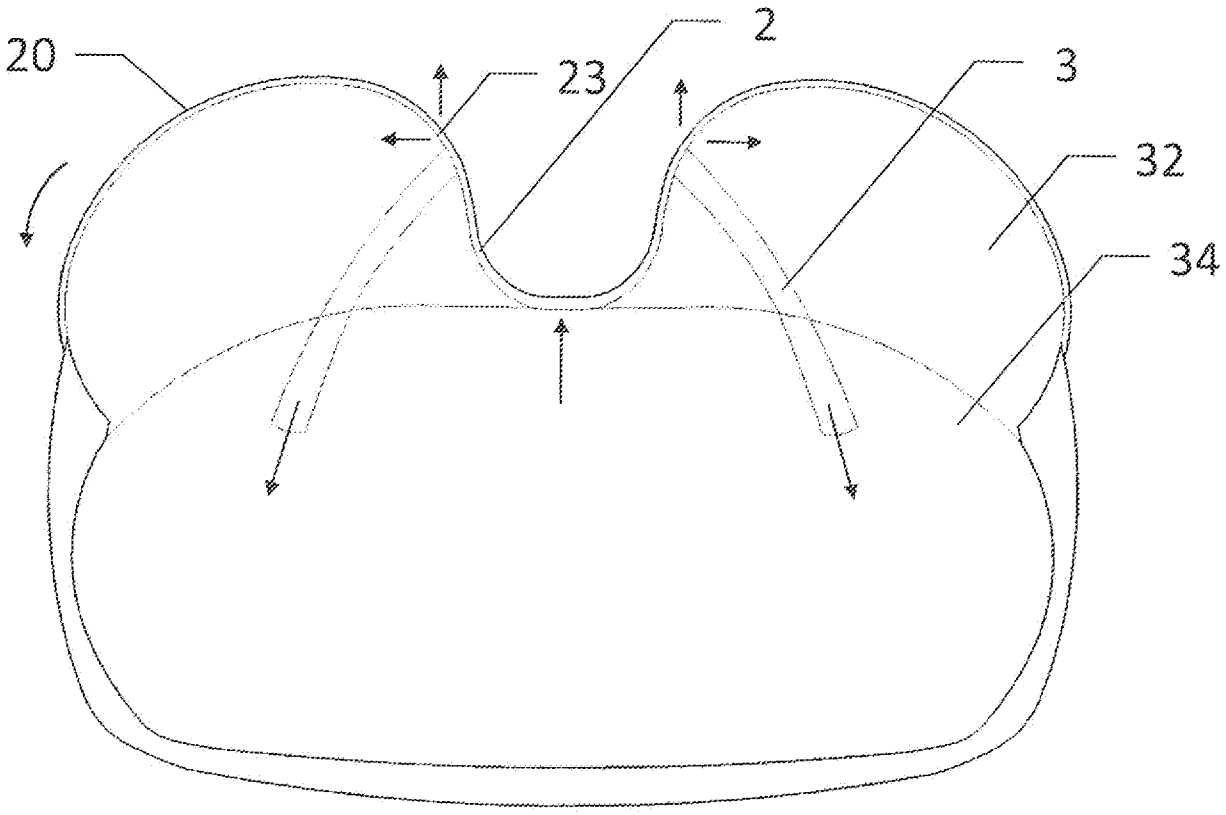

Elements in tension, either as part of the cup or separately, attach the extended side components of the rigid bridge member 2 to the underhand 6 thereby creating a component of force (in association with the angle of the tension line from the shoulder strap 3 to the end of the rigid bridge) towards the sternum. This horizontal force inwards holds the rigid bridge against the chest wall and therefore defines how the cups sit on the rib cage. Resolving forces along the shoulder strap shows that at the shoulder the net tension is down and proceeding away from the shoulder towards the rigid bridge, increasingly there arise horizontal components due to tension in the cup edge. FIGS. 5A, 5B and 5C illustrate the forces acting on the bridge member. In FIG. 5A the arrows shown on the bridge member 2 illustrate the forces from the weight of the breast within the cup 1 together with a horizontal force to maintain the shape. With reference to FIG. 5B it can be seen that the forces on the sling cup 1 are entirely vertical. The shoulder strap 3 is angled backwards so the tension in the strap 3 is not vertical but has a horizontal component towards the ribcage 34 which tends to, hold the bridge component 2 into the chest. A small horizontal force from the ribcage 34 balances the horizontal component of the shoulder strap 3 tension. If the horizontal forces are not in line the overall construction of the bra structure will have to generate a couple.

FIG. 5C illustrates the horizontal forces only showing that the bridge member is pressed against the ribcage. By moving the attachment points forward more horizontal force can be generated to hold the bridge member in place. The sling cups have lateral horizontal forces which balance each other.

FIG. 5C also illustrates means 20 to contain the breasts and stop them from falling off the sling cups should they be subjected to a component of force, due to a forward component of an acceleration vector. The means 20 may also have properties which can shape the breasts by flattening. In either case, for restraint or for flattening, the tensions and other three in the means 20 need to be connected to parts of the bra structure which will transmit them to parts of the wearer which will maintain them, i.e. the ribcage or shoulders.

The restraint 20 or flattening means is illustrated in FIG. 5*c* as material in tension attached at point PL 23 on the rigid bridge member 2. At this contact point there is a component of force, due to tension, both forwards and sideways. This is illustrated by the arrows. It can be seen that the sideways component of the force is balanced by a similar and opposite force on the contact point PR on the other side. This is due to the rigid bridge member transmitting the force from PL to PR. The component of force in the forward direction is subtracted from the force provided by the two other items attached to each of these points, i.e., the shoulder straps and the sling cups. The shoulder straps 3 as shown in FIG. 5*c* have a component of force inwards towards the chest of the wearer. The sling cups are not in a straight line as seen from above. The ribcage and thus the breasts of the wearer are curved. If a line is drawn in the horizontal plane between the suspension points on the bridge member 2 and the extension to the rigid wing for the line of the left breast this is not co-linear with the line which be drawn for the right breast. In supporting the weight of each breast m the sling cup there is—just as in the suspension of a hammock—a horizontal force due to the weight of the breast as well as the vertical component. The horizontal force direction due to the suspension of the sling cup is shown in FIG. 5*c* as the Axis of Breast. This inward component tends to maintain the rigid bridge member pressed against the sternum of the wearer.

The bridge member can be made of any suitable material which gives the required stiffness and comfort.

Figure 6:
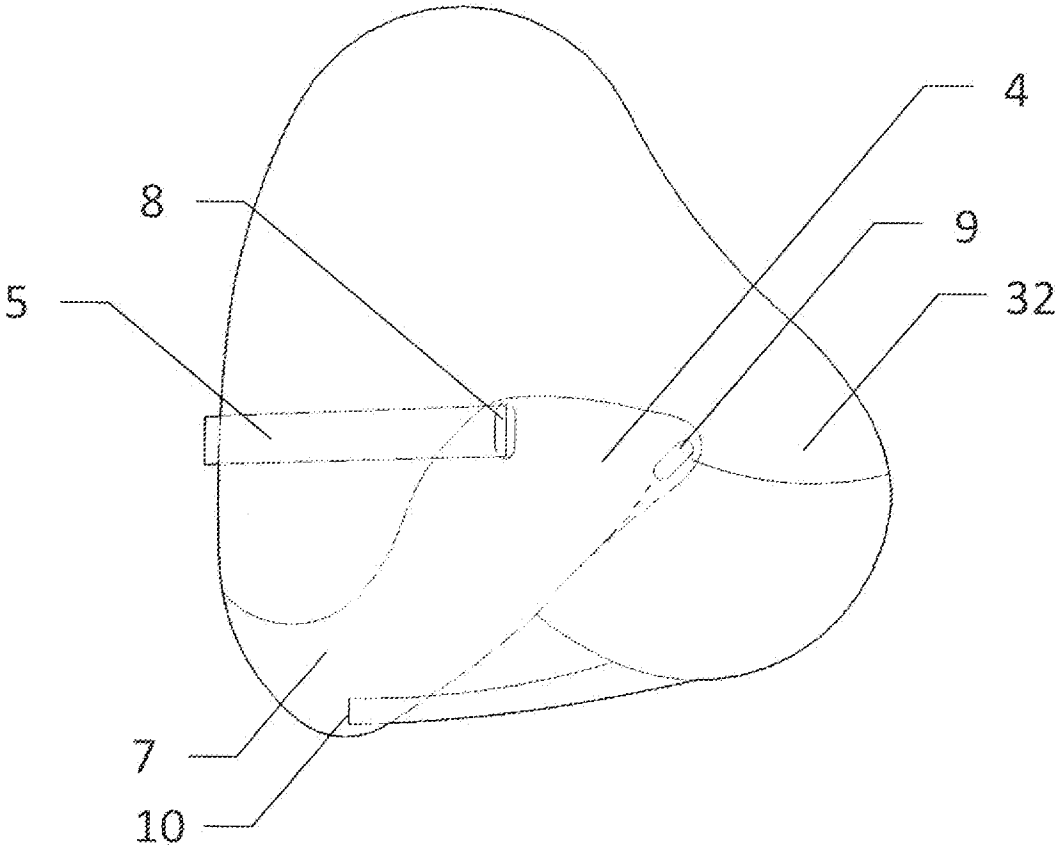
FIG. 6 is a diagrammatic side view of a bra structure in accordance with an embodiment of the invention.

The forwardly extending rigid wing arrangement will now be described with particular to FIG. 6.

The rigid wing 7 forms the side of the bra structure and provides attachment points for the interconnection of the shoulder strap 3, the sling cup 1, a backband 5 and an underband 6. The wing itself can in various different shapes, the only criteria being that the attachment points are provided at the correct locations so as to balance the couple due to the tension in the backband against the couple due to the shoulder strap and cup, i.e. $Wa/2=Tb$, where W is the weight of the cup, T is the tension in the backband, a is the horizontal distance between where the vertical forces act and b is the vertical distance between where the horizontal forces act. As can be seen in FIG. 6 the rigid wing 7 is provided with an upper frontal end 4 which has an attachment point 9 for connection of the sling cup 1 to the wing 7. Towards the rear of the wing there is provided an attachment point 8. This is shown in the drawing as substantially horizontal to attachment point 9 but those skilled in the art will realise it does not have to be. This attachment point 8 is for a back band 5 which extends across the back of a wearer when the bra is worn. Towards the lower back end of the wing there is provided an attachment point, not illustrated, for the shoulder strap. At the frontal end of the structure is an attachment point 10 for an underband. This is illustrated in FIG. 6 as rear of the attachment point 8. However, as above, those skilled in the art will realise it does not have to be.

The bra structure will also likely include cup extensions to support the front of the breast between the triangle formed of the top of the sling cup element. The part of the shoulder strap between the shoulder and the bridge component and a connecting piece found in all bra structures which runs from the wing to the shoulder strap.

Figure 7:
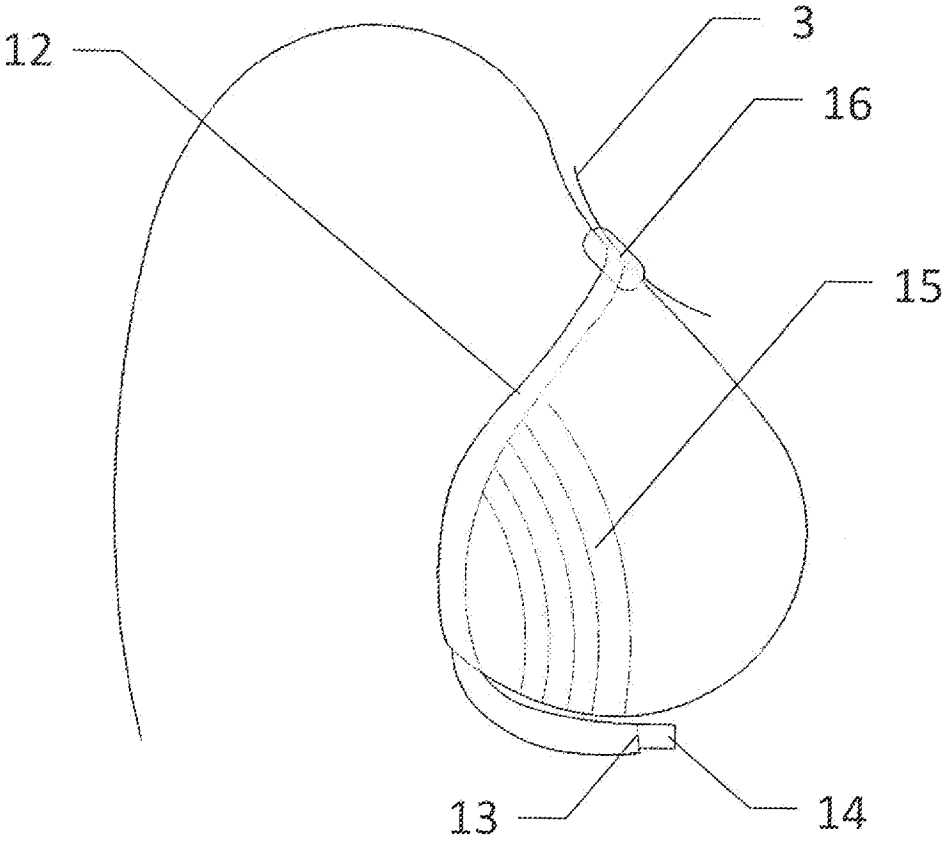
FIG. 7 is a diagrammatic side view of a bra structure in accordance with an embodiment of the invention.

FIG. 7 illustrates a further component which may be added to the bra structure of the present invention to provide extra side control. This component is optional and is not an essential feature of the invention.

The main component of this side structure is a rigid but springy elongate control member 12. The upper end of the member 12 is attached at its upper end to the frontal part of the shoulder strap 3, at attachment point 16. The lower end of the member 12 is attached to the underband. A piece of fabric 15 can be tensioned by the control member 12 to control the shape of the side of the cup and hold the side of the breast.

Horizontal side pressure of the bust causes horizontal forces at the attachment points. The horizontal forces are balanced at the lower end by increased tension in the underband. The increased tension in the underband is again entirely symmetrical in that the left hand element is connected in tension to the bottom of the right hand element and the tension occurs where the curvature of the cage is slight so that very hale horizontal pressure is experienced by the wearer. The upper end of the member 12 can derive horizontal forces only by altering the geometry of the shoulder strap 3. This is the change of angle in the shoulder strap at the point where the member 12 is connected to it. Tension panels are fixed within the framework of the member 12 at the required tensions to provide the desired curvature. Those tensions are entirely contained within the frame. They do not transmit to the wearer.

The control member 12 may be made of underwire or a moulding or any other suitable material. The fabric held in tension can be stiff or compliant.

As stated above it will be understood that the control member 12 is not essential to the invention but is merely a further option should extra side control be required.

Figure 8:
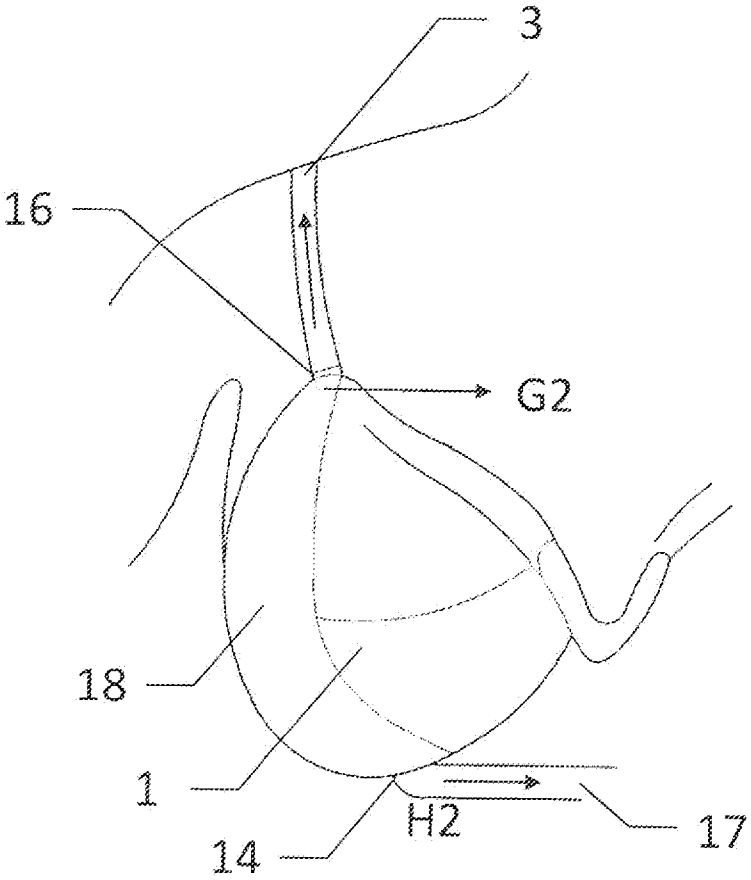
FIG. 8 is a front view illustrating the forces acting in accordance with a further embodiment of the invention.

FIG. 8 is a front view of the bra structure illustrating the forces acting in accordance with a further embodiment of the invention. In this embodiment a panel of cloth, side panel 18, or other tension carrying material is connected between points 14 and 16. A degree of side flattening of the breast can be achieved with this panel of cloth even without a rigid frame. The forces are illustrated in FIG. 8. The horizontal forces are provided by G2—the change in direction of the supporting shoulder strap 3 at that junction—and H2 where the panel is attached to the underband 17 at attachment point 14. Only the forces of one panel are shown in FIG. 8. The other panel is the same but mirrored so that the forces are all balanced.

The invention has been described above with respect to a preferred embodiment. The preferred embodiment includes the sling cups, the rigid bridge member and the rigid wing.

However if will be understood by those skilled in the art that each of these features can be used individually in combination with conventional bra structures to improve the bra structure.

The rigid bridge member can be used with an otherwise conventional bra structure. As will be understood from the above in general the forces available are purely in tension and always in a hoop direction unless a rigid component is employed. The usual rigid component in conventional bras is the underwire. As regards the central front region the hoop tension in the underwires together with the torsion forces in the wire cause a radial force towards the ribcage. This force can in turn tension fabric in that region so as to maintain a pressure on the breast to hold it is a different shape compared to its unsupported shape. The forces involved may be static or dynamic or both.

A frame bra, i.e. one without underwires, does not have such radial forces and so its ability to define a shape would be enhanced by a component which does generate some. The rigid bridge member can provide a useful contribution to this alone, i.e. even without the sling cups and rigid wings. Without underwires a bra needs a component to push the centre of the bra towards the sternum so as to define the shape of the cleavage and to hold tension in material so as to support the breasts in this centre region. The rigidity of the bridge member of the present invention allows the attachment of the shoulders straps to beheld away froth the ribcage at an angle such that there is a horizontal radial component inwards towards the chest of the wearer. This means that the rigid bridge member can support fabric tension acting against the hydrostatic pressure which the breast exerts on the material arranged to support them.

A conventional bra without underwiring may sometimes have a crises cross construction which allows the shoulder straps to provide lift in the centre region. It can be considered that the right strap lifts the inner edge of the leftcup and the left strap lifts the inner edge of the right cup. By using this type of deployment of the shoulder straps, i.e. by bringing the shoulder straps across the bust so that the right side of the left cup is tensioned by the right shoulder strap and vice versa the use of sling cups in accordance with the present invention is possible without the other features described above. Whether or not the sling cups are used with the other features of the invention some additional swing preventing material will enhance the bra structure.

Supporting the sling cup at the side is greatly aided by the use of the rigid wings described above but it can be used without. In a more conventional support method a grip on the chest will be generated by increasing the hoop tension iii the backband/underband loop. Such tension must be kept out of the sling cup by running the force in an underband positioned either below the cup or behind it or in between. A convenient point is then found on the wing to provide the "hammock" force needed for the sling cup.

As described above the sling cup is likely to be accompanied by extensions to support the front of the breast between the triangle formed of the top of the sling cup element, the part of the shoulder strap between the shoulder and the bridge component and the connecting piece found in all bra structures which runs from the wing to the shoulder strap.

It will be understood by those skilled in the art that changes and modifications may be made to each of the preferred embodiments without departing from the scope of the invention as set out in the appended claims.

Having described my invention, I claim:

1. A bra structure, for use for a wearer having at least one breast and a ribcage, wherein said bra structure comprises:

a. a left cup member and a right cup member, each having a left side and a right side, b. a left shoulder strap and a right shoulder strap, each having a front end and a back end, c. a pair of respective side members interconnecting said cup members and said back ends of said shoulder straps; and d. a bridge member having a left side and a right side interconnecting said cup members and said front ends of said shoulder straps, wherein said bridge member is configured to transmit tension from said left shoulder strap to said left side of said right cup member, and wherein said bridge member is configured to transmit tension from said right shoulder strap to said right side of said left cup member, each of said cup members comprising a sling, said sling being symmetrical about a vertical axis whereby when worn said cup member extends up and behind said breast of said wearer.

2. A bra structure, for use by a wearer having a ribcage and at least one breast, comprising:

a. a left cup member and a right cup member, each having a left side and a right side, b. a left shoulder strap and a right shoulder strap, each having a front end and a back end, c. a pair of respective side members interconnecting said cup members and said back end of said shoulder strap; and d. a frontal semi rigid bridge member extending forwardly and interconnecting said cup members and said front ends of said shoulder straps, wherein said bridge member is configured to transmit tension from said left shoulder strap to said left side of said right cup member, and wherein said bridge member is configured to transmit tension from said right shoulder strap to said right side of said left cup member.

3. A bra structure as claimed in claim 2, wherein:

a. said bridge member has a left side, a middle, and a right side, with said middle bearing against said rib cage of said user and said left side and said right sides extending forward from said rib cage of said user; and b. said front end of said left shoulder strap attaches to said left side of said bridge member and said front end of said right shoulder strap attaches to said right side of said bridge member.

4. A bra structure as claimed in claim 3, wherein said frontal semi rigid bridge member is substantially U-shaped, comprising a horizontal member with a side member extending upwardly and outwardly from either end thereof.

5. A bra structure as claimed in claim 1, comprising:

a. an underband connecting said side members and passing beneath said left cup member and said right cup member;

b. a left elongate control member having an upper end and a lower end, wherein said left elongate control member is attached at said upper end thereof to said front end of said left shoulder strap, and at said lower end thereof to said underband;

c. a right elongate control member having an upper end and a lower end, wherein said right elongate control member is attached at said upper end thereof to said front end of said right shoulder strap, and at said lower end thereof to said underband.

6. A bra structure as claimed in claim 1, including a complaint foam piece located behind said left and right cup members such that, when worn, a space is maintained between the back of said cu members and said ribcage.

7. A bra structure as claimed in claim 2, wherein each said cup member further comprises a sling, said sling being symmetrical about a vertical axis whereby when worn said cup member extends up and behind said breast of said wearer.

8. A bra structure as claimed in claim 7, wherein said frontal semi rigid bridge member is substantially U-shaped, comprising a horizontal member with a side member extending upwardly and outwardly from either end thereof.

9. A bra structure as claimed in claim 3, comprising:

a. an underband connecting said side members and passing beneath said left cup member and said right cup member;

b. a left elongate control member having an upper end and a lower end, wherein said left elongate control member is attached at said upper end thereof to said front end of said left shoulder strap, and at said lower end thereof to said underband;

c. a right elongate control member having an upper end and a lower end, wherein said right elongate control member is attached at said upper end thereof to said front end of said right shoulder strap, and at said lower end thereof to said underband.

10. A bra structure as claimed in claim 3, including a complaint foam piece located behind said left and right cup members such that, when worn, a space is maintained between the back of said cup members and said ribcage.

* * * * *